US006524226B2

(12) United States Patent
Kushner

(10) Patent No.: US 6,524,226 B2
(45) Date of Patent: Feb. 25, 2003

(54) EXERCISE DEVICE

(76) Inventor: Stephen Kushner, 371 NW. 76th Ave., No. 103, Margate, FL (US) 33063

( * ) Notice: Subject to any disclaimer, the term of this patent is extended or adjusted under 35 U.S.C. 154(b) by 182 days.

(21) Appl. No.: 09/774,690

(22) Filed: Feb. 1, 2001

(65) Prior Publication Data

US 2002/0103059 A1 Aug. 1, 2002

(51) Int. Cl.[7] ..... A63B 21/04
(52) U.S. Cl. ..... 482/126; 482/81
(58) Field of Search ..... 482/121, 124, 482/125, 126, 81–82, 139, 907

(56) References Cited

U.S. PATENT DOCUMENTS 3,807,730 A 4/1974 Dalton et al.
4,109,906 A * 8/1978 Wilson ..... 482/110
4,733,862 A 3/1988 Miller
4,762,318 A 8/1988 Phillips et al.
4,934,691 A 6/1990 Rudd
5,643,149 A * 7/1997 Grimaldi et al. ..... 482/122
5,681,248 A 10/1997 Vani
5,885,196 A 3/1999 Gvoich

FOREIGN PATENT DOCUMENTS

DE 562787 10/1932

* cited by examiner

*Primary Examiner*—Stephen R. Crow
(74) *Attorney, Agent, or Firm*—Stephen R. Greiner

(57) ABSTRACT

An exercise device including a pair of elastic bands, the inner ends of which are joined together by a releasable fastener. The outer ends of the elastic bands are each provided with a lateral handle and a longitudinal handle. To gain exercise, a user may grasp the lateral handles to stretch the elastic bands when they are joined together by fastener. Alternatively, a user may grasp the longitudinal handles to swing the elastic bands in circles when such are detached from one another.

7 Claims, 2 Drawing Sheets

EXERCISE DEVICE

FIELD OF THE INVENTION

The present invention relates generally to exercise devices and, more particularly, to such devices having resilient force resistance elements with a pair of handles.

BACKGROUND OF THE INVENTION

Numerous exercise devices employing resilient force resistance elements such as elastic bands have been proposed in the past. Unfortunately, most were designed in a manner that permitted a user to exercise only a few of his body's major muscle groups. Further, it is not believed that any of these devices could be effectively used to obtain both anaerobic, strength training and aerobic, cardiovascular exercising. For these reasons, widespread, commercial acceptance of exercise devices with resilient force resistance elements has not yet occurred.

SUMMARY OF THE INVENTION

In light of the problems associated with the known exercise devices, it is a principal object of the invention to provide an exercise device with resilient force resistance elements that may be easily incorporated into both aerobic and anaerobic exercise routines. One or a group of users may employ the device(s), for example, as part of a kickboxing, dance, jump rope and strength-training workout. In terms of calories burned, it is believed that ten minutes of use of the inventive device is equivalent to about twenty minutes of jogging.

It is another object of the invention to provide an exercise device of the type described that may be effectively and safely used with minimal instruction and may be adjusted to accommodate users of different sizes without resort to any tools.

It is an object of the invention to provide improved elements and arrangements thereof in an exercise device for the purposes described which is lightweight in construction, inexpensive to manufacture, and dependable in use.

Briefly, the exercise device in accordance with this invention achieves the intended objects by featuring a pair of elastic bands having an inner end and an outer end. A snap hook is secured to the inner end of one of the elastic bands and an attachment ring, adapted for releasable attachment to the snap hook, is secured to the inner end of the other. A pair of protective coverings, being hollow, foam rubber balls, are positioned over the attachment ring and the snap hook. A pair of endless belts is secured to the outer ends of the elastic bands. A pair of lateral handles is positioned on the endless belts. A pair of longitudinal handles is fitted over, and secured to, the outer ends of the elastic bands.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
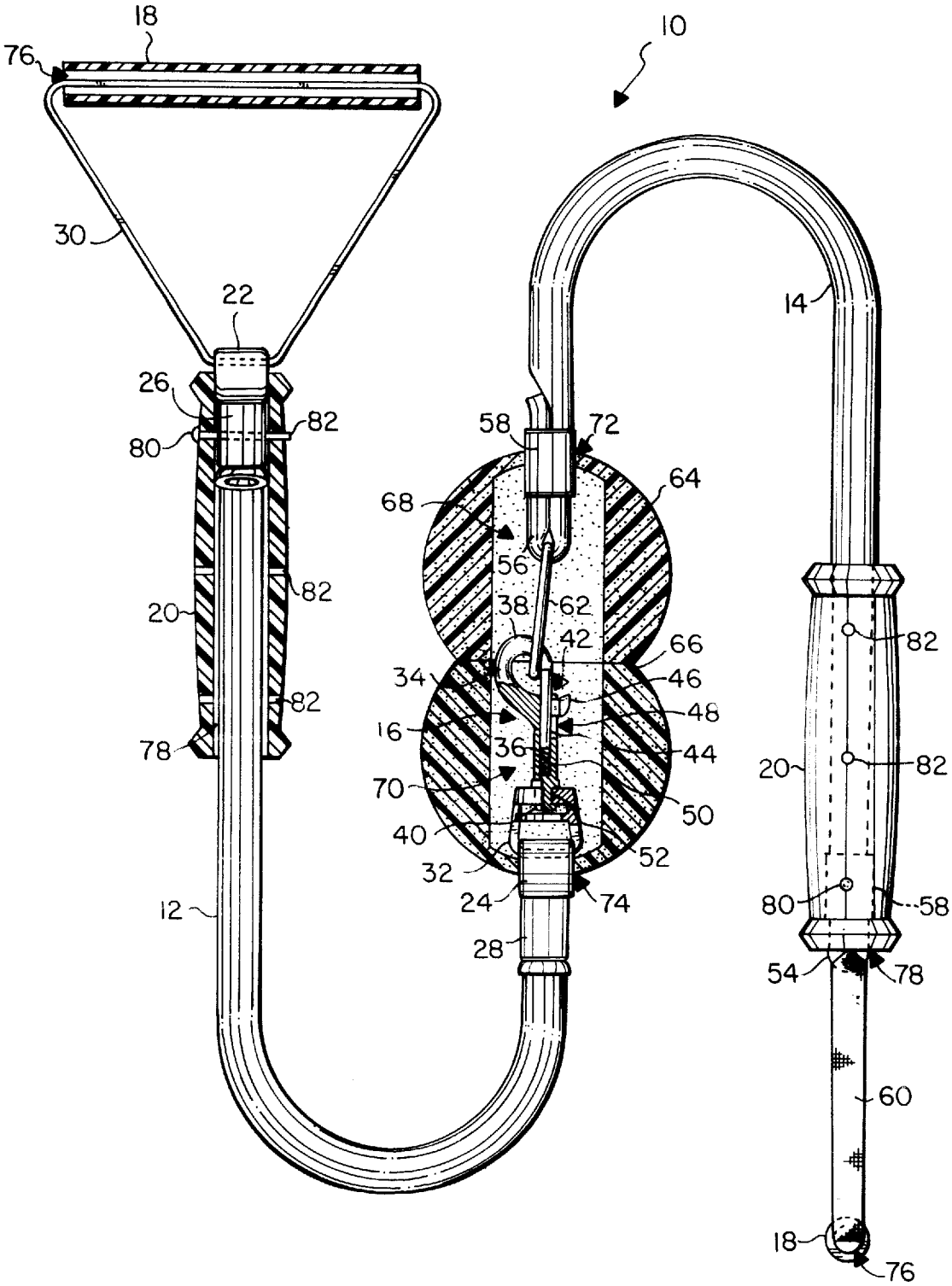
FIG. 1 is a side view of an exercise device in accordance with the present invention with portions broken away to reveal details thereof.

Referring now to the FIGS., an exercise device in accordance with the present invention is shown at 10. Exercise device 10 includes a pair of elastic bands 12 and 14, the inner ends of which are joined together by a releasable fastener 16. The outer ends of bands 12 and 14, however, are each provided with a lateral handle 18 and a longitudinal handle 20. A user may grasp the lateral handles 18 to easily stretch bands 12 and 14 joined together by fastener 16 or may grasp the longitudinal handles 20 to swing bands 12 and 14 in circles when such are detached from one another.

Elastic bands 12 and 14 are formed from surgical tubing or like material. Each band 12 and 14 has a length of about 21 inches (53 cm) and a diameter of about 0.5 inches (1.25 cm) when relaxed. When tension is applied, each band 12 and 14 is capable of being stretched to several times its relaxed length without yielding.

Loops 22 and 24 are formed at the outer and inner ends of band 12 by folding band 12 back upon itself and securing the overlapping portions in place with tight-fitting collars 26 and 28 positioned a short distance from the folds. Loop 22 carries an endless belt 30 formed from heavy-duty webbing and has a nominal diameter of about 4 inches (10 cm). Loop 24, on the other hand, grasps the coupling ring 32 of fastener 16.

Fastener 16 is a snap hook having a body portion 34 pivotally secured to coupling ring 32. Body portion 34 has a shank 36 with a hook 38 at one of its ends and a pin 40 at the other. Shank 36 is provided with a longitudinal bore 42 within which a reciprocating bolt 44 is positioned. Bolt 44 has a shoulder 46 projecting from its side that slides in a slot 48 in the side of shank 36 that opens into bore 42. A compressed spring 50 is positioned in the bottom of bore 42 and urges bolt 44 upwardly into engagement with the free end of hook 38. Pin 40 has a narrowed portion that is loosely received within an aperture 52 in coupling ring 32.

Loops 54 and 56 are formed at the outer and inner ends of band 14 in the same manner as such are formed in band 12. Tight fitting collars 58 and 59 retain loops 54 and 56 in band 12. As shown, loop 54 carries an endless belt 60 identical to belt 30. Loop 56, on the other hand, grasps an attachment ring 62 that may be releasably fastened to fastener 16 as shown in FIG. 1.

Protective coverings 64 and 66 are provided to attachment ring 62 and fastener 16 to defend a user against side impacts from these hard elements. Coverings 64 and 66 are foam rubber balls having diameters of about 3.3 inches (8.5 cm), sufficient to contain within their transverse openings 68 and 70 the attachment ring 62 and fastener 16. As shown, the outer ends 72 and 74 of openings 68 and 70 are narrowed to prevent slippage over attachment ring 62 and fastener 16. To ensure against any slippage, outer ends 72 and 74 may be adhesively secured the outer ends of bands 12 and 14.

Lateral handles 18 are hollow tubes formed of rigid plastic. Handles 18 each measure about 4.75 inches (12 cm) in length and 0.75 inches (2 cm) in diameter. Belts 30 and 60 pass through interior passageways 76 in handles 18 so as to secure handles 18 to bands 12 and 14.

Longitudinal handles 20 are hollow tubes formed of soft plastic. Each handle 20 is about 5 inches (13 cm) long and 1.25 inches (3 cm) in diameter. Handles 20 have interior passages 78 with inner ends and outer ends through which bands 12 and 14 extend. Loops 22 and 54 can project from the outer ends of handles 20 and are retained there by means of pins 80 extending transversely through apertures in handles 20, collars 26 and 59, and the portion of bands 12 and 14 within collars 26 and 59. It is of note that handles 20 are provided with a series of aligned apertures 82 through which pins 80 can be extended so that the length of bands 12 and 14 projecting from the inner ends of handles 20 can be adjusted to suit the needs of a user.

Figure 3:
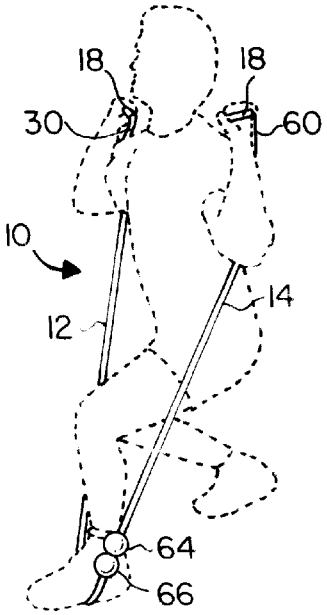
FIG. 3 is a perspective view of the exercise device having its elastic bands attached to one another and being used to perform lunges.

Use of exercise device 10 is straightforward, such being capable of working many muscle groups. To exercise the legs and buttocks, bands 12 and 14 are first joined together by means of fastener 16 and lateral handles 18 are grasped in the hands of a user. Then, a user places his left foot on band 12 adjacent protective covering 66, capturing band 12 against the floor. Next, a user bends his left knee and, with elbows pointed outwardly, elevates his hands to the level of his chin as shown in FIG. 3. Finally, the user straightens his knees so as to assume a standing posture. A desired number of repetitions are obtained with the left foot on band 12 and, then, the process is repeated with the right foot standing upon band 14.

Figure 4:
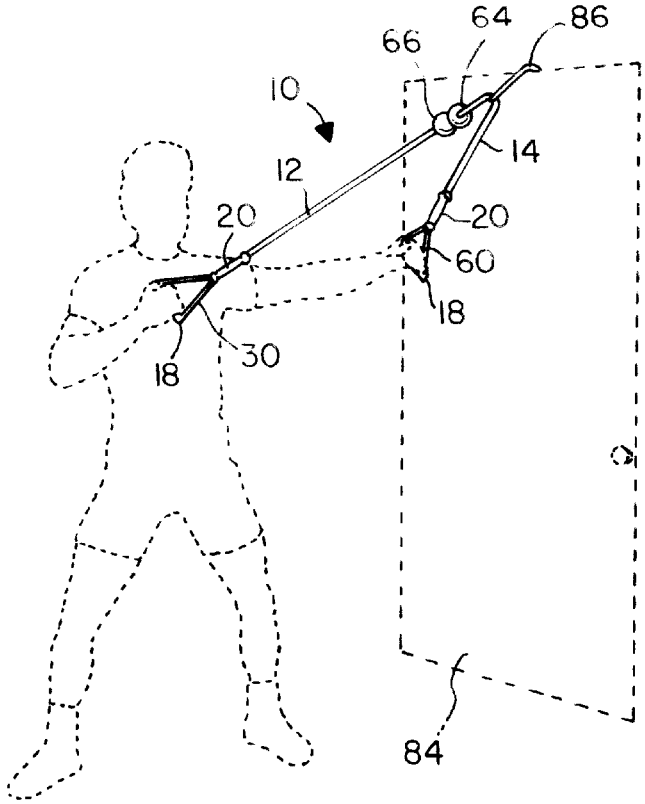
FIG. 4 is a perspective view of the exercise device having its elastic bands attached to one another and being secured to the top of a door so that a user may perform chest flies.

As is illustrated in FIG. 4, a user may exercise the muscles of the chest, shoulders and upper back by attaching joined-together bands 12 and 14 to a door 84 or other supporting surface. (Attachment to door 84 is accomplished by means of an endless belt 86 formed of heavy-duty webbing and having a large knot (not shown) tied in it. Belt 86 is merely slipped over the top door 84 with the knot being placed on the side thereof away from a user. When door 84 is closed, the knot is captured between the doorframe (not shown) and door 84 thereby providing a secure anchor for use of device 10 which is looped through belt 86.) After attaching device 10, the user, standing with his left side towards door 84, grasps lateral handles 18 in his hands and repeatedly pulls band 14 toward his chest left arm. A desired number of repetitions are obtained before the user reverses positions to work his right arm.

Figure 2:
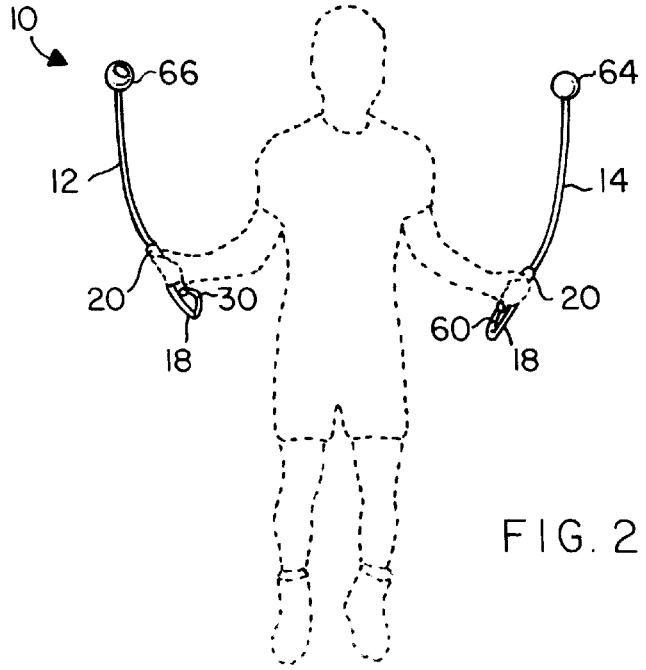
FIG. 2 is a perspective view of the exercise device of FIG. 1 having its elastic bands detached from one another and being swung in the manner of a jump rope at the sides of a user.

Another exercise involves separating bands 12 and 14 from one another by releasing ring 62 from the grip of fastener 16. Here, as is shown in FIG. 2, a user grips longitudinal handles 20 in his hands and, then, swings bands 12 and 14 in circles adjacent the sides of his body in the manner of jumping rope. For additional exercise, the user may jump or skip when the outer ends of bands 12 and 14 come closest to the floor during each of their rotations. The user need never worry that his feet will become tangled in bands 12 and 14 as with actual jump roping thus permitting his footwork to be varied and refined endlessly. Further, because bands 12 and 14 are relatively short, not having to pass beneath the feet, or over the head, of a user like a jump rope, device 10 can be used practically anywhere including spaces with relatively low ceilings.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. An exercise device, comprising:

a pair of elastic bands each having an inner end and an outer end;

a fastener releasably joining said inner end of each of said elastic bands together;

a pair of lateral handles each being respectively tethered to said outer end of one of said elastic bands; and, a pair of longitudinal handles each being respectively fitted over, and secured to, said outer end of one of said elastic bands.

2. The exercise device according to claim 1 wherein said fastener is a snap hook.

3. An exercise device comprising:

a pair of elastic bands each having an inner end and an outer end;

a snap hook secured to the inner end of one of said pair of elastic bands;

an attachment ring secured to the inner end of the other one said pair of elastic bands, said attachment ring being adapted for releasable attachment to said snap hook;

a pair of endless belts each being respectively secured to said outer end of one of said elastic bands;

a pair of lateral handles each being respectively secured to one of said endless belts; and, a pair of longitudinal handles each being respectively fitted over, and secured to, said outer end of one of said elastic bands.

4. The exercise device according to claim 3 further comprising a pair of protective coverings each being respectively secured over said attachment ring and said snap hook.

5. The exercise device according to claim 3 wherein each of said protective coverings is a foam rubber ball having a transverse opening for containing either said attachment ring or said snap hook.

6. An exercise device comprising:

a pair of elastic bands each being formed of rubber tubing and having an inner end and an outer end;

a snap hook secured to the inner end of one of said pair of elastic bands;

an attachment ring secured to the inner end of the other one said pair of elastic bands, said attachment ring being adapted for releasable attachment to said snap hook;

a pair of protective coverings each being respectively secured over said attachment ring and said snap hook, each of said protective coverings being a hollow, foam rubber ball;

a pair of endless belts each being respectively secured to said outer end of one of said elastic bands;

a pair of lateral handles each being respectively positioned on one of said endless belts; and, a pair of longitudinal handles each being respectively fitted over, and secured to, said outer end of one of said elastic bands.

7. The exercise device according to claim 6 further wherein each of said longitudinal handles and said bands each have a plurality of apertures capable of axial alignment and said exercise device further comprises a pair of pins, each of said pins being removably positioned in said apertures so as to adjustably join said longitudinal handles and said bands together.

* * * * *